US007796369B2

(12) United States Patent
McCoy et al.

(10) Patent No.: US 7,796,369 B2
(45) Date of Patent: Sep. 14, 2010

(54) DEVICES, SYSTEMS, AND METHODS FOR SHUNTING A CIRCUIT BREAKER

(75) Inventors: Brian Timothy McCoy, Lawrenceville, GA (US); Thomas William Holland, Flowery Branch, GA (US)

(73) Assignee: Siemens Industry, Inc., Alpharetta, GA (US)

( * ) Notice: Subject to any disclaimer, the term of this patent is extended or adjusted under 35 U.S.C. 154(b) by 782 days.

(21) Appl. No.: 11/796,195

(22) Filed: Apr. 27, 2007

(65) Prior Publication Data

US 2007/0253130 A1 Nov. 1, 2007

Related U.S. Application Data

(60) Provisional application No. 60/746,104, filed on May 1, 2006.

(51) Int. Cl.
*H01H 73/00* (2006.01)

(52) U.S. Cl. ..... 361/115; 361/2

(58) Field of Classification Search ..... 361/2, 361/115, 116; 335/201, 202; 218/15–20, 218/22, 29–30, 34–36, 38, 40, 147–149, 218/157

See application file for complete search history.

(56) References Cited

U.S. PATENT DOCUMENTS

| | | | | |
|---|---|---|---|---|
| 2,134,565 | A | 10/1938 | Leonarc | |
| 3,040,144 | A | 6/1962 | Norden | |
| 4,516,003 | A * | 5/1985 | Yoshiyasu et al. | 218/150 |
| 5,164,693 | A * | 11/1992 | Yokoyama et al. | 335/14 |
| 5,196,815 | A | 3/1993 | Chien | |
| 5,859,578 | A | 1/1999 | Arnold | |
| 6,084,188 | A * | 7/2000 | Mueller et al. | 200/305 |
| 6,248,970 | B1 * | 6/2001 | DiMarco et al. | 218/149 |
| 6,300,586 | B1 * | 10/2001 | Doughty et al. | 218/148 |
| 2002/0075123 | A1 | 6/2002 | Lias | |

FOREIGN PATENT DOCUMENTS

| | | |
|---|---|---|
| DE | 3619240 | 12/1987 |
| EP | 0255992 | 2/1988 |
| FR | 2344949 | 10/1977 |
| WO | WO95/19631 | 7/1995 |
| WO | WO02/31849 | 4/2002 |

* cited by examiner

*Primary Examiner*—Jared J Fureman
*Assistant Examiner*—Terrence R Willoughby
(74) *Attorney, Agent, or Firm*—Jose de la Rosa

(57) ABSTRACT

Certain exemplary embodiments comprise an electrical bypass conductor adapted for installation in a circuit breaker. The electrical bypass conductor can be adapted to be operatively electrically coupled to a load side of the circuit breaker. The electrical bypass conductor adapted to transfer electrical energy from a source of electrical power to the load side of the circuit breaker during a short circuit event.

20 Claims, 5 Drawing Sheets

DEVICES, SYSTEMS, AND METHODS FOR SHUNTING A CIRCUIT BREAKER

CROSS-REFERENCES TO RELATED APPLICATIONS

This application claims priority to, and incorporates by reference herein in its entirety, pending U.S. Provisional Patent Application Ser. No. 60/746,104, filed 1 May 2006.

BACKGROUND

U.S. Pat. No. 6,248,970 (DiMarco), which is incorporated by reference herein in its entirety, allegedly discloses a "circuit breaker (10) including an electrical arc extinguishing apparatus (105). The electric arc extinguishing arc apparatus (105) includes a first sidewall (106) in a spaced relationship with the second sidewall (107) with a top arc plate (110) mounted between the first and second sidewalls (106, 107). A plurality of intermediate arc plates (114) are mounted between the first (106) and second sidewalls (107) below the top arc plate (110) with each in a spaced apart relationship. A bottom arc plate (116) is mounted between the first and second sidewalls below and apart from the intermediate plates (114) forming an arc chute. The electric arc extinguishing apparatus (105) can also be provided with two end caps (120) with each end cap (120) having an interior cavity (121) with one leg (111) of each arc plate (58) mounted in the cavity (121) of one end cap (120) and the other leg (111) of each arc plate (58) mounted in the cavity (121) of the other end cap (120)." See Abstract.

U.S. Patent Publication No. 20020075123 (Lias), which is incorporated by reference herein in its entirety, allegedly discloses the "high transient current sustained by arcing during opening of the main contacts of a miniature circuit breaker is commutated out of the bimetal by deflection of the bimetal in response to the overcurrent to close secondary contacts on the free end of the bimetal and on a low resistance by-pass conductor shunting the bimetal. The by-pass conductor can be extended toward the movable contact arm carrying the movable main contact to commutate some of the overcurrent into the by-pass conductor earlier in the opening sequence to reduce the energy input to the bimetal and reduce the force closing the secondary contacts." See Abstract.

SUMMARY

Certain exemplary embodiments comprise an electrical bypass conductor adapted for installation in a circuit breaker. The electrical bypass conductor can be adapted to be operatively electrically coupled to a load side of the circuit breaker. The electrical bypass conductor adapted to transfer electrical energy from a source of electrical power to the load side of the circuit breaker during a short circuit event.

BRIEF DESCRIPTION OF THE DRAWINGS

A wide variety of potential practical and useful embodiments will be more readily understood through the following detailed description of certain exemplary embodiments, with reference to the accompanying exemplary drawings in which.

DETAILED DESCRIPTION

Figure 1:
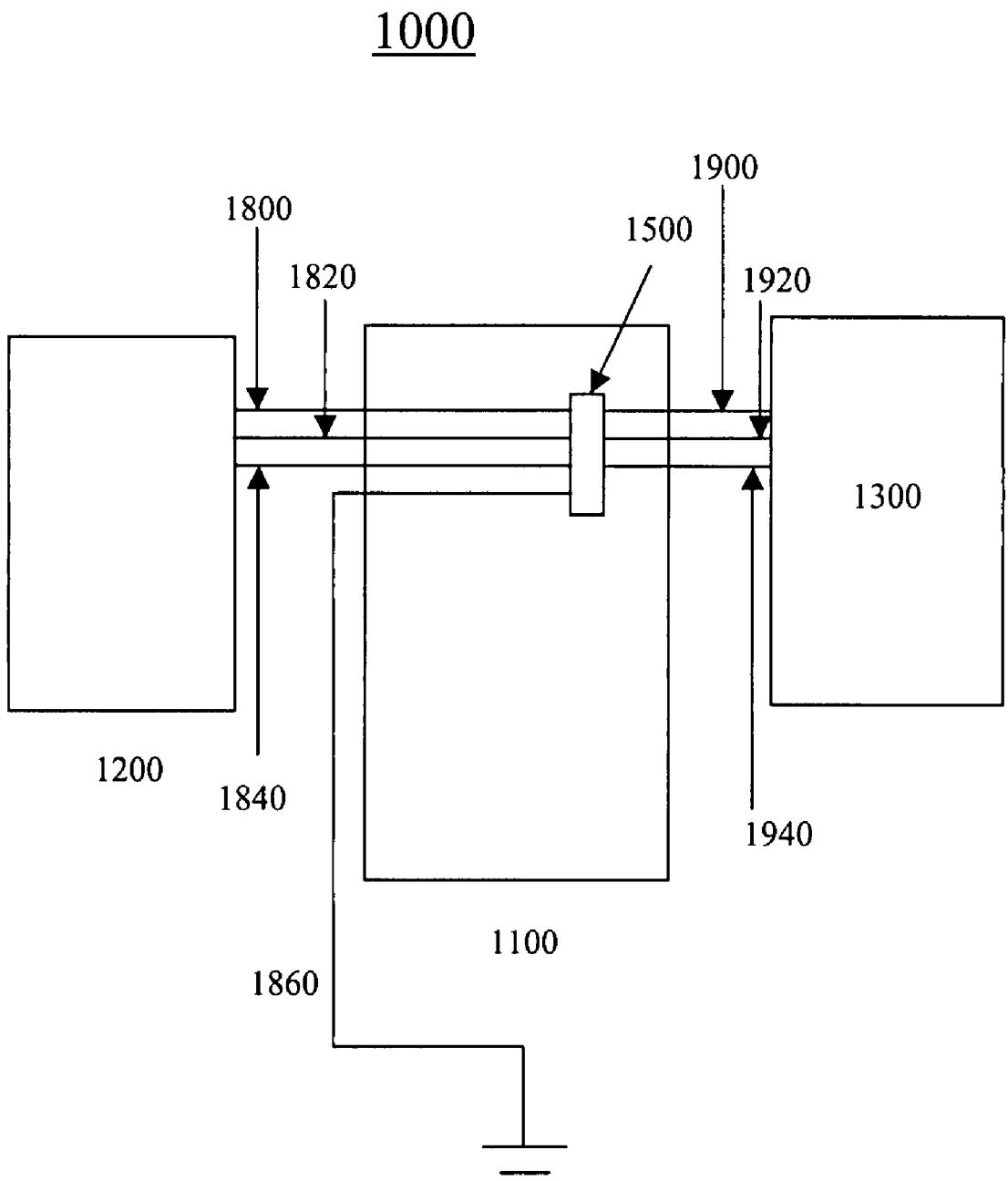
FIG. 1 is a block diagram of an exemplary embodiment of a system 1000.

Certain exemplary embodiments provide an electrical bypass conductor adapted for installation in a circuit breaker. The electrical bypass conductor can be adapted to be operatively electrically coupled to a load side of the circuit breaker. The electrical bypass conductor adapted to transfer electrical energy from a source of electrical power to the load side of the circuit breaker during a short circuit event.

When a circuit breaker is automatically tripped by a trip mechanism or manually tripped by a handle, an operating mechanism can be adapted to release a moveable contact arm. In certain exemplary short circuit events, an electrical arc generated during such an operation can be transferred to one or more arc plates and/or arc plate configurations as the contact arm moves through the arc plate and/or arc plate configuration. One or more arc plates can define a two-tined fork through which the contact arm can pass. The electrical arc can propagate across one or more arc plates and/or an arc plate configuration. Arc plates can be adapted to create, induce, and/or direct an electrical arc to flow, travel, and/or conduct over a defined and/or desired portion of the circuit breaker, and/or to decrease, minimize, and/or limit the duration of time that an arc flows, travels, and/or conducts between the contact surfaces, thereby potentially resisting, reducing, minimizing, limiting, and/or preventing unwanted arc-based erosion and/or arc-based deposition involving one or more of the contact surfaces.

During a short circuit event, a circuit breaker can be adapted to extinguish arcing, high amperage, and/or high voltage involving the circuit. In some cases, when the circuit breaker opens, that is, when and/or as the contact surfaces of the circuit breaker separate, arc plates alone might not be sufficient to dissipate and/or reroute the electrical energy flowing within a circuit breaker. Certain exemplary embodiments can comprise a secondary path for a relatively high voltage and/or high current that might harm circuit breaker components that comprise a current path. Certain exemplary embodiments can comprise an electrical bypass conductor, which can have a first end and a second end. The first end can have a shape that substantially matches and/or is substantially similar to a shape of an arc plate. The shape of the first end can substantially resemble a "Y" shape and/or can define at least two prongs and/or tines of a fork. The contact arm can be adapted to pass between the prongs without making direct contact therewith. Such a shape can allow a contact arm to pass through the electrical bypass conductor during a short circuit event and to route electrical energy through and/or via one or more of the forks that is electrically connected to a secondary path, thus bypassing most current carrying parts in the circuit breaker that might be damaged during the short circuit event. The second end of the electrical bypass conductor can be wedged and/or biasedly fixed against a lug and thereby be electrically coupled to the lug.

Certain exemplary embodiments can comprise an electrical bypass conductor that defines an arc end having a shape that is similar and/or identical to one or more arc plates comprised by the circuit breaker. The electrical bypass conductor and/or its arc end can be modified to suit a particular arc chamber configuration. The contact arm can pass through the prongs of the two-tined fork defined by the arc end, which can be substantially similar in shape to at least a portion of an arc plate and/or arc configuration. Various ferrous and non-ferrous materials can be used to customize the functionality of the electrical bypass conductor and/or its arc end. For example, the electrical bypass conductor and/or arc end can be fabricated from cast iron, steel, copper, brass, bronze, aluminum, silver, gold, and/or any other electrically conductive material, etc.

FIG. 1 is a block diagram of an exemplary embodiment of a system 1000, which can comprise an electrical panel 1100. Electrical panel 1100 can be utilized to electrically couple an electrical source 1200 to an electrical load 1300. Electrical load 1300 can be associated with a home, factory, office building, commercial warehouse, store, government building, construction site, sports facility, mobile plant, camp site, recreational facility, trailer home, emergency site, and/or farm, etc.

Electrical panel 1100 can comprise one or more circuit breaker cases 1500. Components comprised by circuit breaker case 1500 can be operably energizable by 100 volts or greater. A first plurality of conductors can electrically couple electrical source 1200 to components comprised by circuit breaker case 1500. The first plurality of conductors can comprise a first source conductor 1800, a second source conductor 1820, and a third source conductor 1840. A ground 1860 can be electrically coupled to a component of circuit breaker case 1500. Each of first source conductor 1800, second source conductor 1820, third source conductor 1840, and/or ground 1860 can be operably connectable to one or more circuit breakers, such as one or more components comprised by circuit breaker case 1500.

A second plurality of conductors can electrically couple electrical load 1300 to one or more components comprised by circuit breaker case 1500. The second plurality of conductors can comprise a first load conductor 1900, a second load conductor 1920, and a third load conductor 1940. Each of second load conductor 1920, third load conductor 1940, and/or ground 1860 can be operably connectable to one or more circuit breakers, such as components comprised by circuit breaker case 1500.

Figure 2:
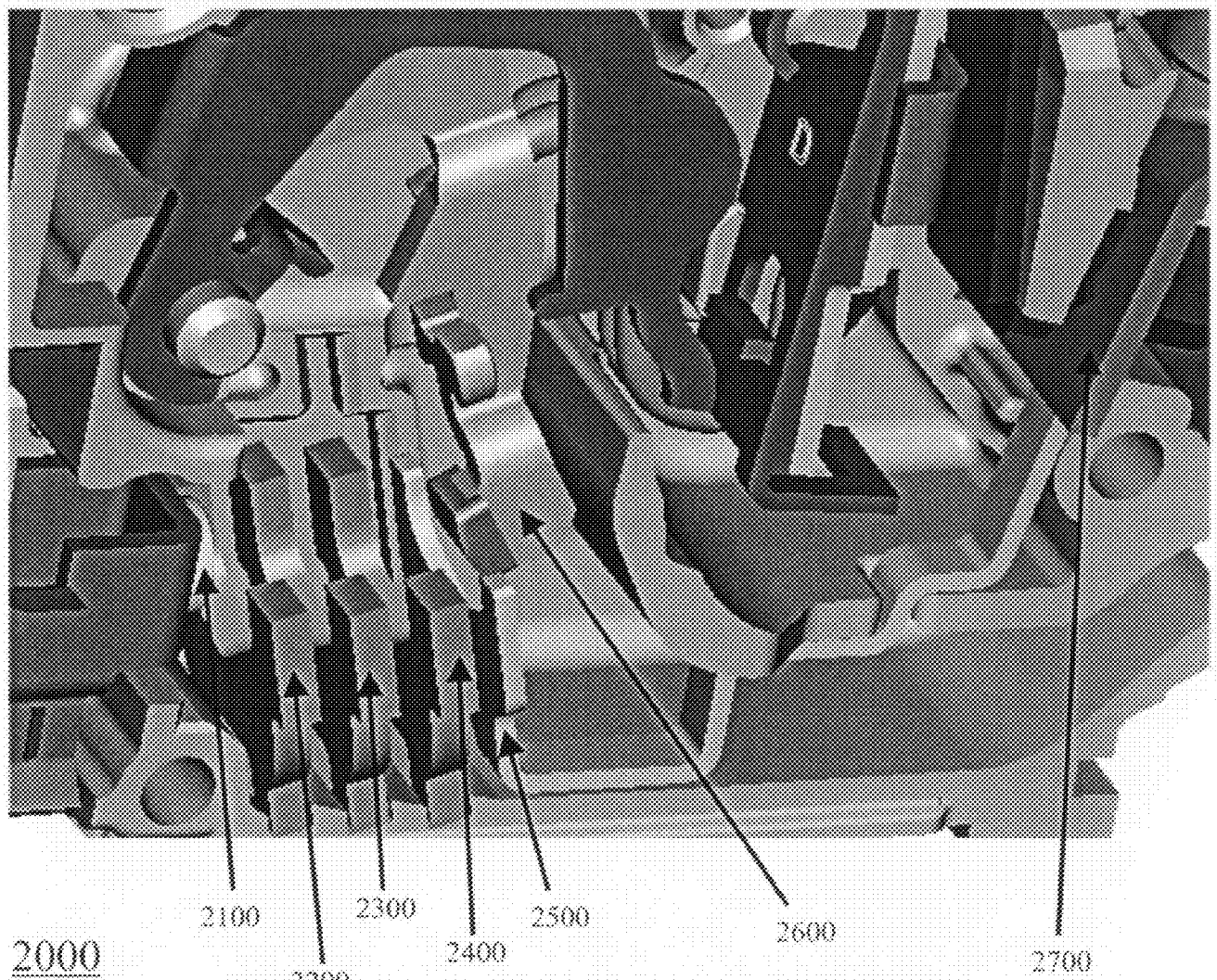
FIG. 2 is a perspective view of an exemplary embodiment of a system 2000.

FIG. 2 is a perspective view of an exemplary embodiment of a system 2000, which can comprise a plurality of circuit breaker components. System 2000 can comprise an electrical source contact 2100, which can be operatively coupled to a source of electrical energy. System 2000 can comprise a load side contact arm 2600, which can be adapted to, when in contact with electrical source contact 2100, transfer electrical energy to a load side of a circuit breaker that comprises system 2000. Load side contact arm 2600 can be adapted to retract to the position illustrated in system 2000 responsive to a short circuit event on a load side and/or supply side of the circuit breaker that comprises system 2000. System 2000 can comprise a plurality of arc plates and/or arc plate configurations, such as arc plate 2200, arc plate 2300, and/or arc plate 2400. Arc plate configurations, such as arc plate 2200, arc plate 2300, and/or arc plate 2400, can be a component of a primary shunt, within the circuit breaker adapted for transferring and/or dissipating electrical energy during a short circuit event.

During a short circuit event load side contact arm 2600 can begin to move from a state of being in contact with electrical source contact 2100. As load side contact arm 2600 begins to move, an arc can form between load side contact arm 2600 and electrical source contact 2100, which can damage surfaces of load side contact arm 2600 and/or electrical source contact 2100. Since arc plate 2200 is in relatively close proximity to electrical source contact 2100, as contact arm 2600 retracts, when a sufficient electrical potential difference exists between electrical source contact 2100 and load side contact arm 2600, an arc can form between electrical source contact 2100 and arc plate 2200. The arc formed between electrical source contact 2100 and arc plate 2200 can limit damage to contact surfaces of load side contact arm 2600 and/or electrical source contact 2100. When a sufficient electrical potential difference exists, an arc can develop between arc plate 2200 and arc plate 2300. If the potential difference is sufficiently high, an arc can develop between arc plate 2300 and arc plate 2400, which under certain levels of electrical potential can result in arcing between arc plate 2400 and electrical bypass conductor 2500.

Electrical bypass conductor 2500 can be electrically coupled and/or fastenerlessly attached to a lug 2700, which can be located on a load side of the circuit breaker and/or electrically coupled to an electrical load. Electrical energy from the short circuit event can be, at least partially, routed to the electrical load via arc plate 2200, arc plate 2300, arc plate 2400, electrical bypass conductor 2500, and lug 2700. Electrical bypass conductor 2500 can be a fastenerless electrical bypass conductor 2500 adapted for installation in the circuit breaker. Electrical bypass conductor 2500 can comprise a fork that can define a first prong and/or a second prong. The first prong and the second prong can be adapted to allow passage of contact arm 2600 therebetween. The fork can be similarly shaped to at least one arc plate configuration (such as arc plate 2200, arc plate 2300, and/or arc plate 2400). Electrical bypass conductor 1500 can be adapted to be operatively electrically coupled to a load side of the circuit breaker. Electrical bypass conductor 2500 can be adapted to transfer electrical energy from a source of electrical power, via at least one arc plate configuration (such as arc plate 2200, arc plate 2300, and/or arc plate 2400), to the load side of the circuit breaker during the short circuit event.

Figure 3:
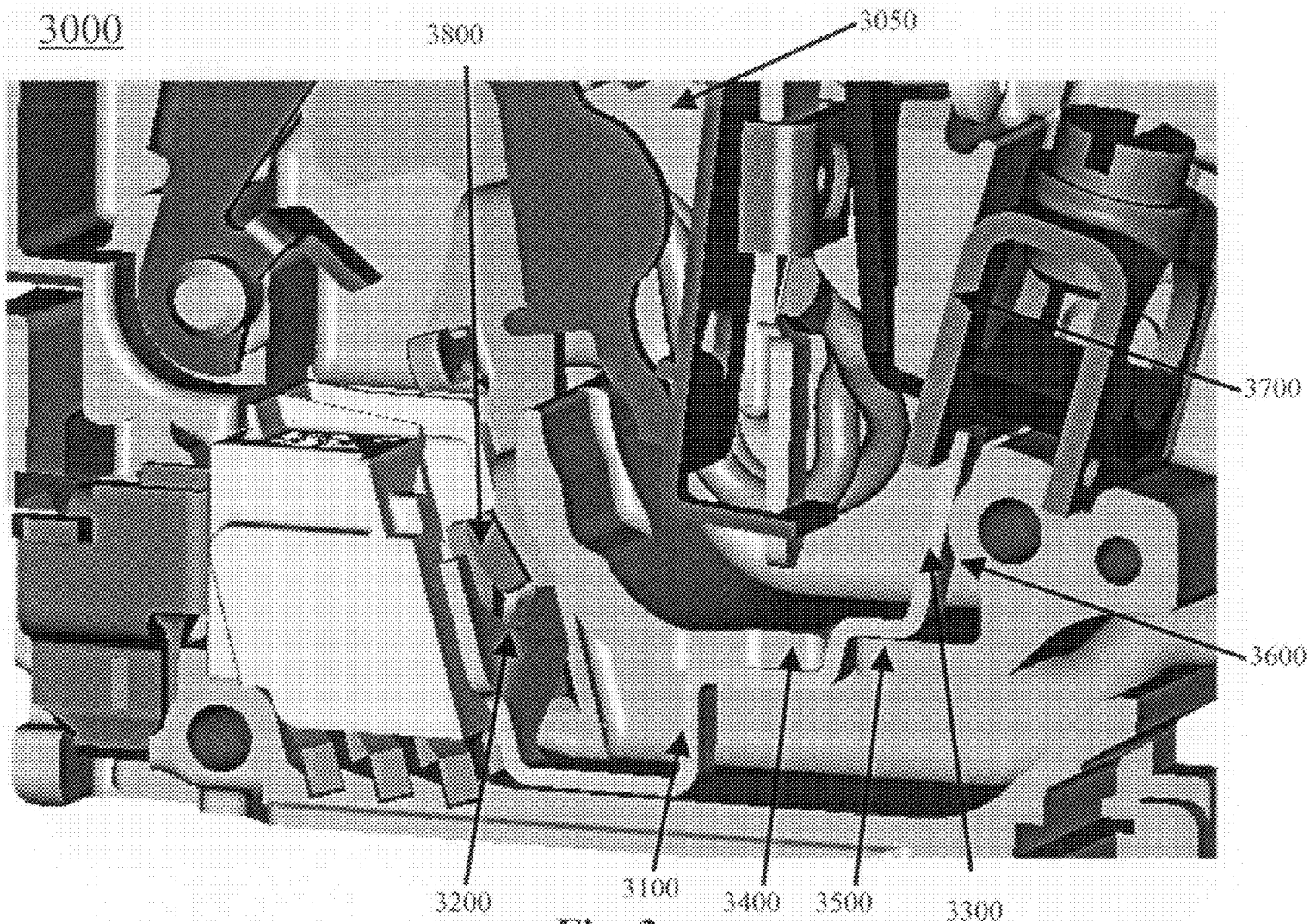
FIG. 3 is a perspective view of an exemplary embodiment of a system 3000.

FIG. 3 is a perspective view of an exemplary embodiment of a system 3000, which can represent a partial cross sectional view of a portion of a circuit breaker. System 3000 can comprise an electrical bypass conductor 3100, which can comprise a first end 3200 and a second end 3300. First end 3200 can define a two-tined fork comprising a first prong and a second prong. Components comprised in system 3000 can be integral to and/or separate from a housing structure comprising system 3000. In certain exemplary embodiments, portions of system 3000 such as a retainer surface 3400, retainer surface 3500, and retainer surface 3600 can be non-integral to a housing of the circuit breaker and can be fixedly and/or releasably attached thereto.

Electrical bypass conductor 3100 can be fastenerless, and/or can be adapted to be releasably, springably, biasedly, and/or fastenerlessly seated between at least two surfaces, such as retainer surface 3400, retainer surface 3500, and/or retainer surface 3600, of circuit breaker case 3050. Electrical bypass conductor 3100 can be adapted to be releasably seated in circuit breaker case 3050. Electrical bypass conductor 3100 can be adapted to contact at least one of retainer surface 3400, retainer surface 3500 and retainer surface 3600 defined by circuit breaker case 3050. Electrical bypass conductor 3100 can be adapted to be installed, secured, and/or retained in circuit breaker case 3050 via tension, bias, and/or releasable and/or elastic deformation. Electrical bypass conductor 3100 can be adapted to be nondestructively removed from circuit breaker case 3050, such as substantially without utilizing a tool, and/or via a gripping tool such as needle-nosed pliers.

The two-tined fork of first end 3200 can be adapted to allow passage of a contact arm 3800 between the first prong and the second prong. Second end 3300 can be adapted to be electrically coupled to a load side lug 3700. The electrical coupling of load side lug 3700 and second end 3300 can result from a biased fit of electrical bypass conductor 3100 between retainer surface 3600 and load side lug 3700. For example, a retainer surface 3600 can act as a fulcrum adapted to urge a bend in electrical bypass conductor 3100 in order to provide a biased electrically conductive contact between second end 3300 of electrical bypass conductor 3100 and lug 3700. Motion of electrical bypass conductor 3100 can be constrained by a fit of electrical bypass conductor 3100 between retainer surface 3400 and retainer surface 3500. In certain exemplary embodiments, a portion of electrical bypass conductor 3100 can rest on retainer surface 3500 of circuit breaker case 3050.

Figure 4:
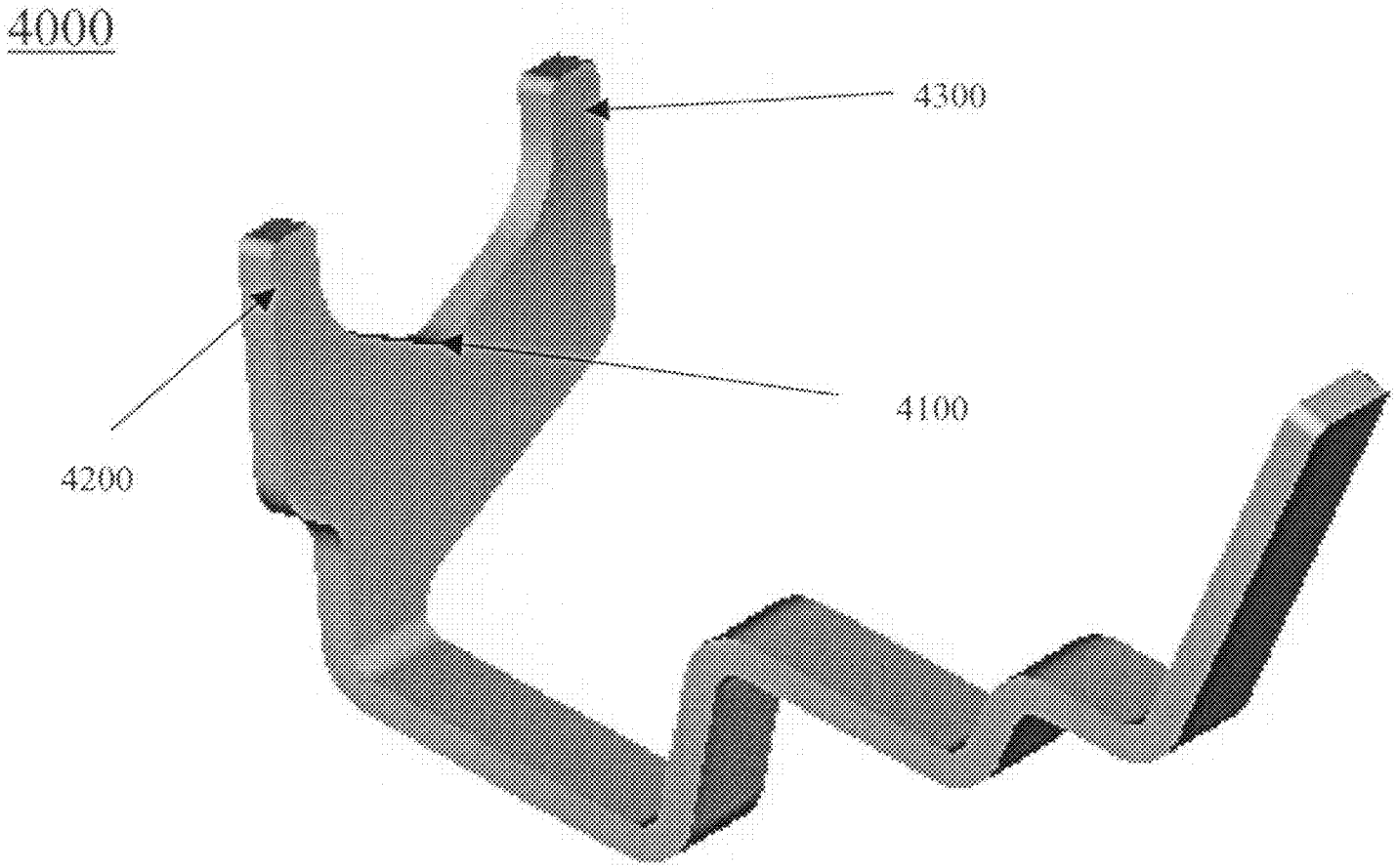
FIG. 4 is a perspective view of an exemplary embodiment of a electrical bypass conductor 4000.

FIG. 4 is a perspective view of an exemplary embodiment of an electrical bypass conductor 4000, which can comprise a fork 4100 that can define a first prong 4100 and/or a second prong 4200.

Figure 5:
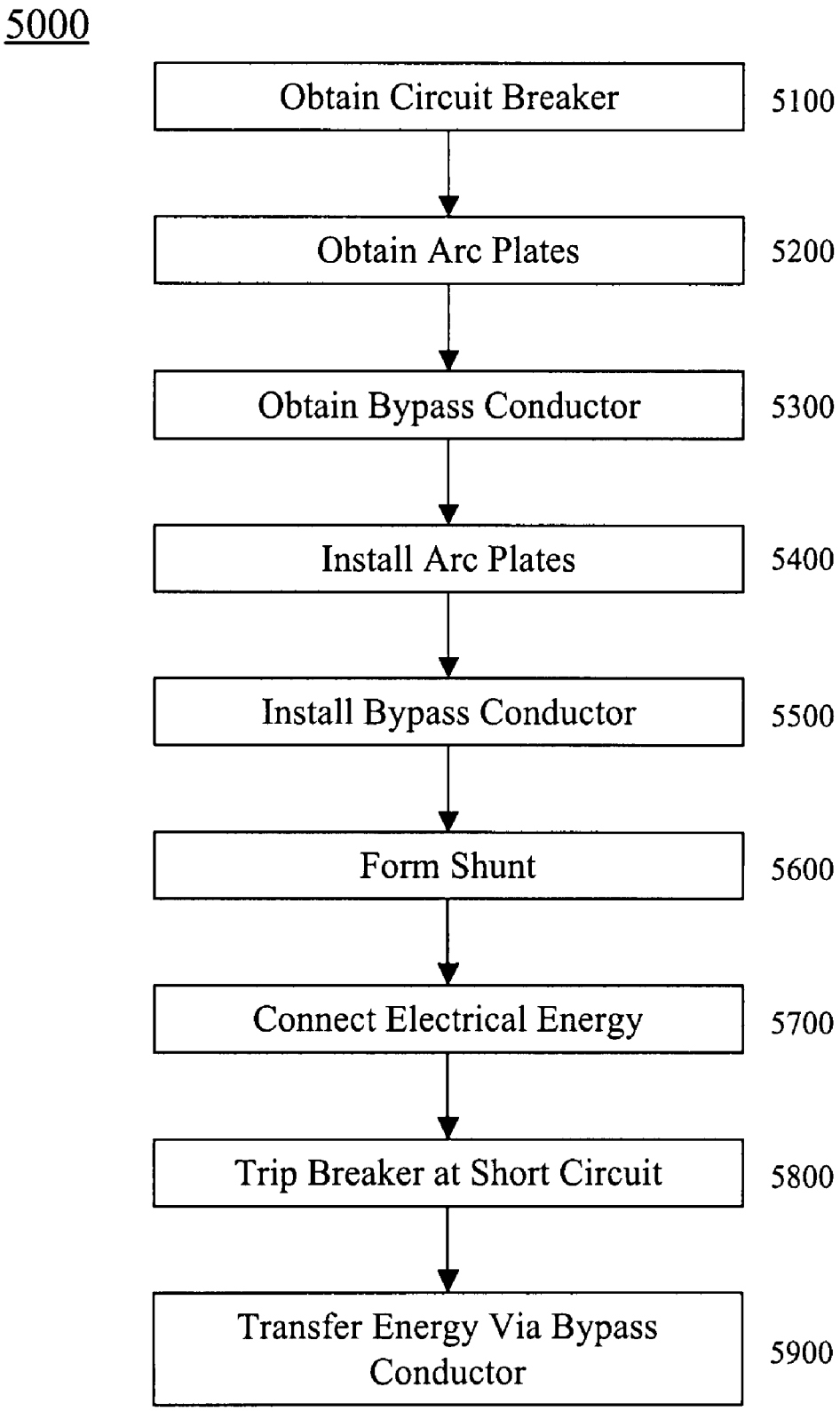
FIG. 5 is a flowchart of an exemplary embodiment of a method 5000.

FIG. 5 is a flowchart of an exemplary embodiment of a method 5000. At activity 5100, a circuit breaker can be obtained.

At activity 5200, arc plates and/or arc plate configurations, adapted to be operatively installed in the circuit breaker, can be obtained. At activity 5300, an electrical bypass conductor can be obtained. At activity 5400, the arc plates can be installed in the circuit breaker. Note that, in certain embodiments, this activity can occur prior to activity 5300.

At activity 5500, the electrical bypass conductor can be installed in the circuit breaker. The electrical bypass conductor can be adapted to be fastenerlessly installed in the circuit breaker and/or releasably attached to the circuit breaker without being heatedly fused and/or installed via a fastener to one or more components comprised by the circuit breaker. For example, the lug end portion of the electrical bypass conductor can be slid between a lug surface and a retaining surface, then the lug end portion can be flexed sufficiently to allow a central portion of the electrical bypass conductor to be slid between two or more retaining surfaces, which can allow an arc end portion of the electrical bypass conductor to slide into position substantially adjacent an arc plate region of the circuit breaker.

The electrical bypass conductor can comprise a fork that can define a first prong and/or a second prong. The first prong and/or the second prong can be adapted to allow passage of a contact arm of the circuit breaker therebetween. The electrical bypass conductor can be adapted to be operatively electrically coupled to a load side of the circuit breaker. The electrical bypass conductor can be adapted to transfer electrical energy from a source of electrical power, via at least one arc plate configuration, to the load side of the circuit breaker during a short circuit event. The electrical bypass conductor can be adapted to substantially electrically bypass at least one component of the circuit breaker during the short circuit event. The contact arm of the circuit breaker, in an operative embodiment, can be adapted to pass between the first prong and the second prong of the electrical bypass conductor during the short circuit event.

At activity 5600, a shunt and/or electrically conductive path can be formed via which current can flow through and/or across the electrical source contact, one or more arc plates, the arc end portion of the electrical bypass conductor, the lug end portion of the electrical bypass conductor, and/or to a load side lug of the circuit breaker, etc. The shunt can be adapted to transfer electrical energy to the load side of the circuit breaker during the short circuit event. The electrical bypass conductor can comprise a lug end portion adapted to be operatively electrically coupled and/or fastenerlessly attached to the lug of the load side of the circuit breaker.

At activity 5700, electrical energy can be operatively connected to the circuit breaker.

At activity 5800, a circuit breaker can be tripped due to a short circuit condition.

At activity 5900, electrical energy associated with the short circuit can be transferred to the load side lug of the circuit breaker via the electrical bypass conductor and/or one or more arc plates and/or arc plate configurations. The electrical bypass conductor and/or the arc plates and/or arc plate configurations can be adapted to attempt to reduce wear and/or damage to contact surfaces of the contact arm and/or an electrical source contact.

DEFINITIONS

When the following terms are used substantively herein, the accompanying definitions apply. These terms and definitions are presented without prejudice, and, consistent with the application, the right to redefine these terms during the prosecution of this application or any application claiming priority hereto is reserved. For the purpose of interpreting a claim of any patent that claims priority hereto, each definition (or redefined term if an original definition was amended during the prosecution of that patent), functions as a clear and unambiguous disavowal of the subject matter outside of that definition.

a—at least one.

activity—an action, act, deed, function, step, and/or process and/or a portion thereof.

adapted for—suitable, fit, and/or capable of performing a specified function.

adapted to—suitable, fit, and/or capable of performing a specified function.

adapter—a device used to effect operative compatibility between different parts of one or more pieces of an apparatus or system.

allow—to provide, let do, happen, and/or permit.

and/or—either in conjunction with or in alternative to.

apparatus—an appliance or device for a particular purpose arc plate configuration—an electrically conductive substantially rigid and/or substantially planar body adapted to act a primary shunt for a circuit breaker when contacts of the circuit breaker open.

associate—to relate, bring together in a relationship, map, combine, join, and/or connect.

at least—not less than.

attach—to fasten, secure, couple, and/or join.

between—in a separating interval and/or intermediate to.

bias—n. a tension and/or force; v. to urge and/or force.

by—with the use of.

bypass—to avoid by using an alternative.

can—is capable of, in at least some embodiments.

case—a container adapted to substantially enclose a circuit breaker, the case comprises integral and/or separable components adapted to fasten, retain, and/or support electrical components comprised by the circuit breaker.

cause—to bring about, provoke, precipitate, produce, elicit, be the reason for, result in, and/or effect.

circuit breaker—a re-settable device adapted to automatically open an alternating current electrical circuit to protect the circuit from damage caused by overload and/or short circuit.

component—a constituent element and/or part.

comprising—including but not limited to, what follows.

configure—to design, arrange, set up, shape, and/or make suitable and/or fit for a specific purpose.

connect—physically or logically join, link, couple, and/or fasten two or more entities.

connective portion—a part of a device adapted to electrically couple the device to an electrical circuit.

contact arm—a member comprising one of a pair of electrical contacts engageable to close a circuit.

convert—to transform, adapt, and/or change, such as from a first form to a second form.

couple—to join, connect, and/or link two things together.

coupleable—capable of being joined, connected, and/or linked together.

create—to make, form, produce, generate, bring into being, and/or cause to exist.

define—to establish the meaning, relationship, outline, form, and/or structure of; and/or to precisely and/or distinctly describe and/or specify.

determine—to obtain, calculate, decide, deduce, establish, and/or ascertain.

device—an instrumentality adapted to a particular purpose.

during—at some time in a time interval.

electrical—relating to producing, distributing, and/or operating by electricity.

electrical energy—energy characterized by, and/or adapted to cause, a flow of electric charge through a conductor.

electrically couple—to connect in a manner adapted to allow a flow of electricity therebetween.

event—an occurrence.

fasten—to attach to something else and/or to hold something in place.

fastener—a distinct restraint that attaches two or more things. A fastener can be a screw, bolt, hook and/or loop of a hook and loop fastener system, button, hook, catch, snap, latch, buckle, loop, tie, clamp, connector, coupler, link, band, zipper, releasable adhesive, plug and socket, and/or any other releasable means for attachment, and/or a glue, bond, weld, and/or any other permanent means for attachment fastenerless—adapted to be positioned and/or retained at a predetermined location and/or adapted to limit motion and/or rotation in one or more predetermined directions without utilizing a fastener. Examples can include tongue and groove joints, wedges, and/or a self-biased interaction between a first part and a second part, etc.

fastenerless electrical bypass conductor—a device, adapted to be installed in a circuit breaker without a fastener, adapted to divert a flow of electrical energy to a load side of a circuit breaker responsive to an opening of contacts of the circuit breaker during a short circuit event.

first—being before all others in an ordering.

for—with a purpose of.

fork—a device having two or more prongs.

form—to make, construct, and/or produce.

from—used to indicate a source.

further—in addition.

fuse—to melt together.

generate—to create, produce, render, give rise to, and/or bring into existence.

heat—energy associated with the motion of atoms and/or molecules and capable of being transmitted through solid and fluid media by conduction, through fluid media by convection, and through a fluid and/or empty space by radiation.

heatedly—via thermal energy.

initialize—to create, produce, render, give rise to, and/or bring into existence.

install—to set in position and/or prepare for use.

installation—a state of being installed.

load side—a portion of an electric circuit breaker that is electrically coupled to at least one electricity utilizing device.

lug—an electrical terminal adapted to be electrically coupled to a conductor, the conductor electrically couplable to an electrical energy source.

may—is allowed and/or permitted to, in at least some embodiments.

method—a process, procedure, and/or collection of related activities for accomplishing something.

method—a process, procedure, and/or collection of related activities for accomplishing something.

more—greater.

nondestructively—to perform substantially without damaging.

occur—to take place.

one—a singular unit.

operative—being in effect; operating.

pass—to move relative to an object.

passage—a motion of a first object relative to a second object.

plurality—the state of being plural and/or more than one.

plurality—the state of being plural and/or more than one.

power—energy, a measure of energy and/or work, and/or a rate at which work is done, expressed as the amount of work per unit time and commonly measured in units such as watt and horsepower.

predetermined—established in advance.

primary—first in an ordering.

prong—a projecting part, such as a protrusion, bar, stub, rod, pin, cylinder, etc.

protect—to attempt to prevent and/or avoid damage.

provide—to furnish or supply.

receive—to gather, take, acquire, obtain, accept, get, and/or have bestowed upon.

releasably—capable of being freed, in a substantially nondestructive manner, from something that binds, fastens, or holds back.

remove—to eliminate, remove, and/or delete, and/or to move from a place or position occupied.

rest—to not move and/or be supported by.

said—when used in a system or device claim, an article indicating a subsequent claim term that has been previously introduced.

seat—to attach to or place firmly in or on something.

second—being immediately after a first item in an exemplary ordering.

secondary—second in an ordering.

shape—a characteristic surface, outline, and/or contour of an entity.

short circuit—an abnormal condition of relatively low resistance between two points of different potential in a circuit resulting in an excess flow of current relative to the range of currents typically conducted via the circuit.

shunt—a device adapted to divert a flow of electrical current.

similar—having a resemblance.

source—an original and/or intermediate transmitter of traffic and/or a related group of such transmitters and/or a point at which something originates, springs into being, and/or from which it derives and/or is obtained.

springably—elastically movable from a first position to a second position.

substantially—to a considerable, large, and/or great, but not necessarily whole and/or entire, extent and/or degree.

support—to bear the weight of, especially from below.

surface—the outer boundary of an object or a material layer constituting or resembling such a boundary.

system—a collection of mechanisms, devices, data, and/or instructions, the collection designed to perform one or more specific functions.

tension—a deformation of an at least partially elastic body.

that—used as the subject or object of a relative clause.

therebetween—in an interval separating a first thing from a second thing.

therethrough—in one end and out another end of an object.

tool—something used to accomplish a task.

transfer—(n) a transmission from one device, place, and/or state to another. (v) to convey from one device, place, and/or state to another.

two—a cardinal number equal to one plus one.

via—by way of and/or utilizing.

weight—a force with which a body is attracted to Earth or another celestial body, equal to the product of the object's mass and the acceleration of gravity.

wherein—in regard to which; and; and/or in addition to.

within—inside.

without—not accompanied by.

Note

Still other practical and useful embodiments will become readily apparent to those skilled in this art from reading the above-recited detailed description and drawings of certain exemplary embodiments. It should be understood that numerous variations, modifications, and additional embodiments are possible, and accordingly, all such variations, modifications, and embodiments are to be regarded as being within the spirit and scope of this application.

Thus, regardless of the content of any portion (e.g., title, field, background, summary, abstract, drawing figure, etc.) of this application, unless clearly specified to the contrary, such as via an explicit definition, assertion, or argument, with respect to any claim, whether of this application and/or any claim of any application claiming priority hereto, and whether originally presented or otherwise:

there is no requirement for the inclusion of any particular described or illustrated characteristic, function, activity, or element, any particular sequence of activities, or any particular interrelationship of elements;

any elements can be integrated, segregated, and/or duplicated;

any activity can be repeated, performed by multiple entities, and/or performed in multiple jurisdictions; and any activity or element can be specifically excluded, the sequence of activities can vary, and/or the interrelationship of elements can vary.

Moreover, when any number or range is described herein, unless clearly stated otherwise, that number or range is approximate. When any range is described herein, unless clearly stated otherwise, that range includes all values therein and all subranges therein. For example, if a range of 1 to 10 is described, that range includes all values therebetween, such as for example, 1.1, 2.5, 3.335, 5, 6.179, 8.9999, etc., and includes all subranges therebetween, such as for example, 1 to 3.65, 2.8 to 8.14, 1.93 to 9, etc.

Any information in any material (e.g., a United States patent, United States patent application, book, article, etc.) that has been incorporated by reference herein, is only incorporated by reference to the extent that no conflict exists between such information and the other statements and drawings set forth herein. In the event of such conflict, including a conflict that would render invalid any claim herein or seeking priority hereto, then any such conflicting information in such incorporated by reference material is specifically not incorporated by reference herein.

Accordingly, the descriptions and drawings are to be regarded as illustrative in nature, and not as restrictive.

What is claimed is:

1. A system comprising:

a fastenerless electrical bypass conductor adapted for operative installation in a circuit breaker, said fastenerless electrical bypass conductor comprising a first end and a second end, a fork that defines a first prong and a second prong at the first end, said first prong and said second prong adapted to allow passage of a contact arm therebetween, said second end of said fastenerless electrical bypass conductor adapted to be operatively electrically coupled to a load side of said circuit breaker, said fastenerless electrical bypass conductor adapted to transfer electrical energy from a source of electrical power, via at least one arc plate configuration, to said load side of said circuit breaker during a short circuit event wherein said fastenerless electrical bypass conductor includes biased electrically conductive contact at the second end.

2. The system of claim 1, further comprising:

said at least one arc plate configuration.

3. The system of claim 1, further comprising:

said circuit breaker.

4. The system of claim 1, further comprising:

said contact arm.

5. The system of claim 1, further comprising:

a lug electrically coupled and fastenerlessly attached to said fastenerless electrical bypass conductor.

6. The system of claim 1, further comprising:

a circuit breaker case, said fastenerless electrical bypass conductor adapted to be releasably and fastenerlessly seated in said circuit breaker case.

7. The system of claim 1, further comprising:

a circuit breaker case, said fastenerless electrical bypass conductor adapted to be releasably, springably, and fastenerlessly seated between at least two surfaces of said circuit breaker case.

8. The system of claim 1, further comprising:

a circuit breaker case, said fastenerless electrical bypass conductor adapted to be releasably seated in said circuit breaker case, said fastenerless electrical bypass conductor adapted to contact at least one surface defined by said circuit breaker case.

9. The system of claim 1, further comprising:

a circuit breaker case, said fastenerless electrical bypass conductor adapted to be biasedly seated in said circuit breaker case.

10. The system of claim 1, further comprising:

a circuit breaker case, said fastenerless electrical bypass conductor adapted to be fastened via tension in said circuit breaker case.

11. The system of claim 1, further comprising:

a circuit breaker case, said fastenerless electrical bypass conductor adapted to be nondestructively removed from said circuit breaker case.

12. The system of claim 1, further comprising:

a circuit breaker case, said fastenerless electrical bypass conductor adapted to be nondestructively removed from said circuit breaker case substantially without a tool.

13. The system of claim 1, wherein said fork is similarly shaped to said at least one arc plate configuration.

14. The system of claim 1, wherein said at least one arc plate configuration is a component of a primary shunt, within said circuit breaker, adapted for transferring electrical energy during said short circuit event.

15. A device comprising:

a fastenerless electrical bypass conductor adapted for operative installation in a circuit breaker, said fastenerless electrical bypass conductor comprising a first end and a second end, the first end including a fork that defines a first prong and a second prong, said first prong and said second prong adapted to allow passage of a contact arm therebetween, and the second end adapted to be electrically coupled to a load side of the circuit breaker, said fastenerless electrical bypass conductor adapted to transfer electrical energy, via at least one arc plate configuration arranged proximate to the first end, to a load side of said circuit breaker during a short circuit event wherein said fastenerless electrical bypass conductor includes biased electrically conductive contact at the second end.

16. A method comprising a plurality of activities, comprising:

fastenerlessly installing an electrical bypass conductor in a circuit breaker, said electrical bypass conductor comprising a first end and a second end, the first end including a fork that defines a first prong and a second prong, said first prong and said second prong adapted to allow passage of a contact arm therebetween, said fastenerless electrical bypass conductor adapted to be operatively electrically coupled with biased electrically conductive contact at the second end to a load side of said circuit breaker, said fastenerless electrical bypass conductor adapted to transfer electrical energy from a source of electrical power, via at least one arc plate configuration located substantially adjacent to the first end, to said load side of said circuit breaker during a short circuit event.

17. The method of claim 16, wherein said fastenerless electrical bypass conductor is adapted to substantially electrically bypass at least one component of said circuit breaker during said short circuit event.

18. The method of claim 16, wherein said fastenerless electrical bypass conductor is adapted to be releasably attached to said circuit breaker without being heatedly fused to one or more components comprised by said circuit breaker.

19. The method of claim 16, wherein said contact arm is adapted to pass between said first prong and said second prong during said short circuit event.

20. A method comprising a plurality of activities, comprising:

fastenerlessly installing an electrical bypass conductor in a circuit breaker, said fastenerless electrical bypass conductor including a first end and a second end, the first end including a fork that defines a first prong and a second prong, said first prong and said second prong adapted to allow passage of a contact arm therebetween, and the second end adapted to be operatively electrically coupled to a load side of said circuit breaker, said fastenerless electrical bypass conductor adapted to transfer electrical energy from a source of electrical power, via at least one arc plate configuration located substantially adjacent to the first end to said load side of said circuit breaker during a short circuit event, wherein said at least one arc plate configuration defines a first prong and a second prong, said first prong and said second prong adapted to allow passage of a contact arm therebetween; and forming a shunt from the at least one arc plate configuration and the electrical bypass conductor which is adapted to transfer electrical energy to a load side of said circuit breaker during said short circuit event, said electrical bypass conductor comprising a connective portion at the second end adapted to be operatively electrically coupled and fastenerlessly attached to a lug of said load side of said circuit breaker by biased electrically conductive contact.

* * * * *